United States Patent [19]

Schenström

[11] Patent Number: 4,817,219

[45] Date of Patent: Apr. 4, 1989

[54] SITTING BATHTUB

[76] Inventor: Sture Schenström, 6, 1:a Kyrkvägsgränd, S-602 10 Norrköping, Sweden

[21] Appl. No.: 946,046

[22] PCT Filed: Mar. 26, 1986

[86] PCT No.: PCT/SE86/00136

§ 371 Date: Nov. 24, 1986

§ 102(e) Date: Nov. 24, 1986

[87] PCT Pub. No.: WO86/05673

PCT Pub. Date: Oct. 9, 1986

[30] Foreign Application Priority Data

Mar. 28, 1985 [SE] Sweden ..... 8501552

[51] Int. Cl.[4] ..... A47K 3/02

[52] U.S. Cl. ..... 4/555; 4/590

[58] Field of Search ..... 4/555–557, 4/590; 292/202, 194, 240, 241, 204, 205; 49/70, 463, 466

[56] References Cited

U.S. PATENT DOCUMENTS

| | | | |
|---|---|---|---|
| D. 285,346 | 8/1986 | Sween | 4/555 |
| 1,144,576 | 6/1915 | Wilson | 292/202 |
| 2,570,053 | 10/1951 | Fowler et al. | 4/556 |
| 4,202,060 | 5/1980 | Touze | 4/556 |
| 4,583,251 | 4/1986 | Karl et al. | 4/556 |
| 4,672,693 | 6/1987 | Schenstrom | 4/555 |

*Primary Examiner*—Henry J. Recla
*Assistant Examiner*—Linda J. Sholl
*Attorney, Agent, or Firm*—Cushman, Darby & Cushman

[57] ABSTRACT

A sitting bathtub has one lateral wall almost completely open. A hatch is placed over the opening so that one of the hatch's lower corners by the weight of the hatch rests against the side wall of the tub. A movable handle is arranged to press the rest of the lower part of the hatch against the side wall to obtain an initial seal. When water is filled into the tub, the hydrostatic pressure against the hatch climbs upwards forcing the sealing function successively to climb in advance upwards over the rising water level. The handle can be operated from inside as well as from outside of the tub. The force with which the handle presses against the inside of the hatch is proportional to the turning angle of the handle.

6 Claims, 4 Drawing Sheets

VIEW FROM O

SITTING BATHTUB

Figure 1B:
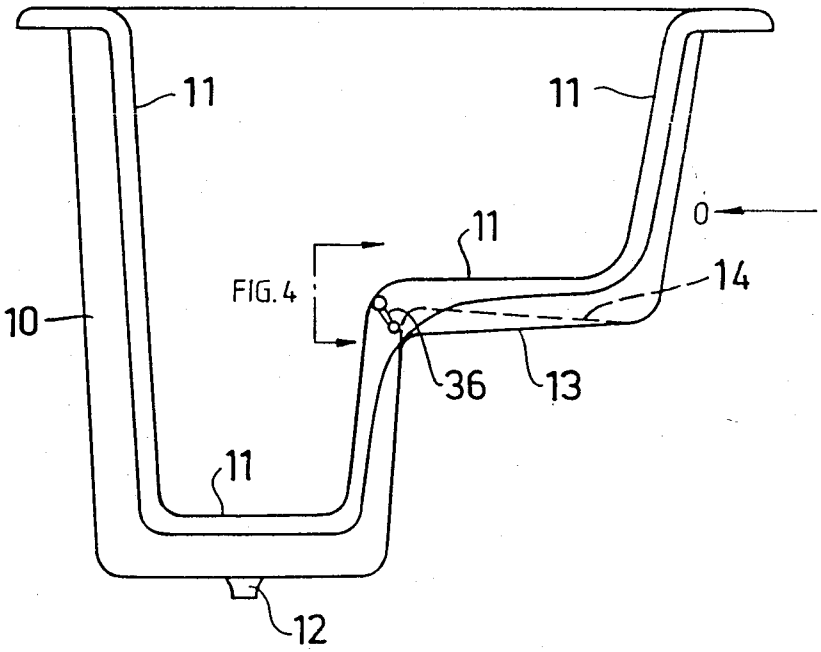

This invention concerns a sitting bathtub with one side of the bathtub almost entirely open from rim to bottom and from front to back and an inwards curved hatch. The side opening of the bathtub is covered from the inside with this hatch after the entrance of the person that is to take a bath via this big lateral opening. Between hatch and the side of the bathtub is arranged a highly elastic seal.

The type of sitting bathtub under consideration (FIG. 1) is primarily intended for disabled, wheelchair users and others with similar movement restrictions. For muscle training in water it is for instance for a physical therapist essential to be able to see into the bathtub from the side in order to study and instruct the bathing and/or training person. The lateral hatch should for this reason among others be made from thinnest possible transparent or clear material for instance acrylic (plexiglass). The bathtub should further have a great depth (80–100 cm) so that the bathing person can be surrounded by water up to shoulders and neck and almost float in the water. The desirable big depth results in a high hydrostatic pressure at the lower part of the hatch and will result in bending outwards of the hatch. For instance it can be mentioned that a flat hatch of acrylic with the dimensions 90×100 cm and the thickness of 6 mm will have an arching outwards in the size of 15–20 mm horizontally as well as vertically. An outward curvature of this size is very apparent and experienced as a great factor of uncertainty in combination with the relatively big water volume (300–400 liters) of the bath when the tub is filled. A smaller curvature is however considered natural. The problem of the great curvature outwards results in a hatch that is precurved or arched inwards. Single or double curved hatch as well as the size of the curvature depends for instance on the material used and the material thickness. Shape and location of the curvature can be varied. Different cases are possible and may influence the shape of the lateral opening of a bathtub in the lateral direction in the sealing zone.

A. If the side of the bathtub at the opening lies in a plane or a single curved surface and the edge zone of the hatch at the sealing follows this plane (this surface) this case is already known from the Swedish Pat. No. 8400091-8. The rest of the curvature inwards of the hatch does not concern the sealing function. The described embodiment can be achieved by vacuum shaping.

B. If the hatch is curved inwards in two directions (or one direction) and this curvature extends out over the sealing zone at the sealing the following two different cases can be separated:

a. The side of the bathtub is at the sealing zone made to follow the curvature that the single or double curved hatch has in the sealing zone in particular in view of the initial seal of the bottom part of the hatch. The basic principle according to the Swedish Pat. No. 8400091-8 (corresponding to U.S. Pat. No. 4,672,693) is also applicable to this case.

b. The hatch is simple or double curved out over the edge zone at the seal and the side of the bathtub lies at the sealing zone in a common flat plane. In this case a gap is established, see FIG. 3, extending from the front lower corner B of the hatch (see FIG. 3) through the corner points C, D, E to F. The gap has its maximum in the area at D in the shown embodiment. In this case it is initially required that this gap is eliminated, at least along the line BC. This can be achieved by applying a force on the inner side of the hatch at D and directed outwards. The area D lies in the close vicinity of the straight line between the points B and F. The force outwards can for instance be achieved by means of a handle (FIG. 4) having an axle extending through the side of the bathtub (rim, inverted U-shape) and which thus easily can be operated from in-as well as from outside the bathtub. The nob in the end of the handle is in direct contact with the inner surface of the hatch pushing this part of the hatch outwards. The axle of the handle is placed in a certain angle relative the normal to the inner side of the bathtub, so that the angle of the handle determines the force influencing the hatch. The initial seal at the bottom part of the hatch is in this case obtained by combination of the weight of the hatch and the force of the handle. When water is filled in the bathtub the wedge-like gap between the hatch and the side wall is successively closed at A-B-C simultaneouls with the remaining gap C-D-E-F. The handle will when the bathtub is filled loose its contact with the inner side of the hatch but has at this time already fulfilled its function.

The handle is in the described embodiement very easy to operate and psychologically important since all of us prefer to be active in some way with some kind of mechanism to feel safe.

The above said is in principle applicable regardless of the material of the hatch. The handle in the desired embodiment can of course be substituted by other types of devices, yes even handforce, filling the same function. The main principle however remains.

Figure 2B:
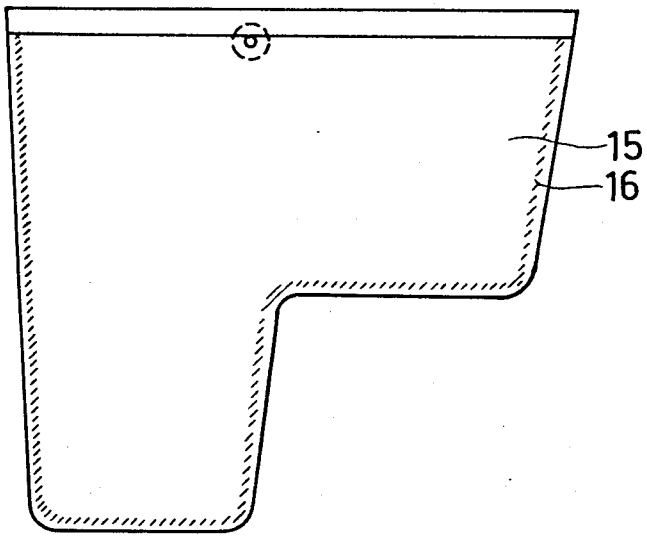
Figure 3:
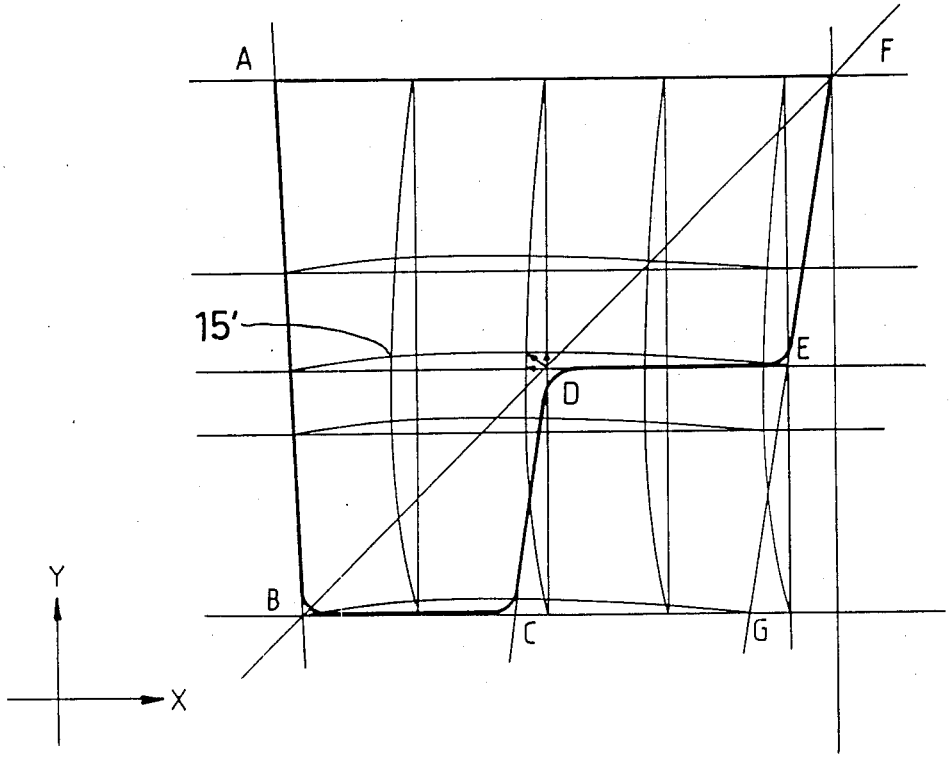
Figure 4:
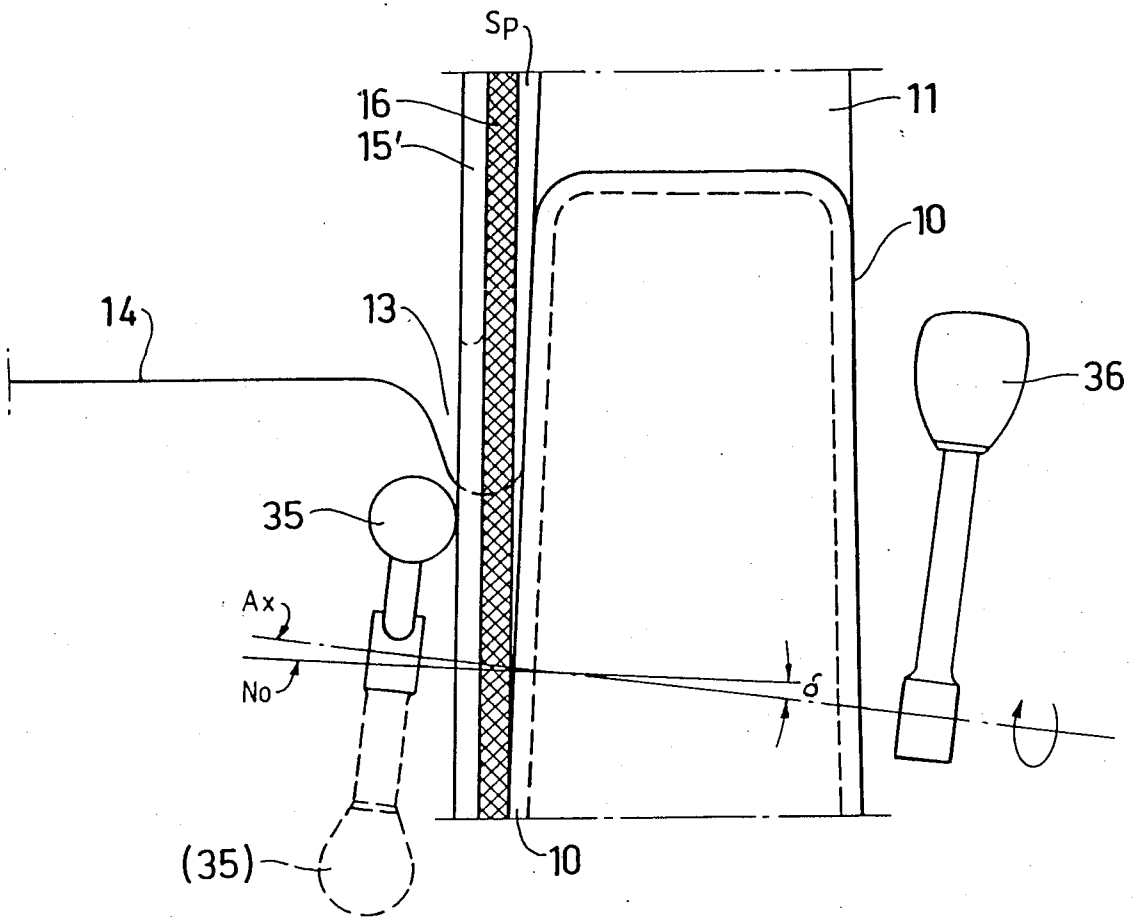

Further advantages and features of the invention are apparent from the following description of a preferred embodiment with reference to the drawings. In the drawing FIG. 1*a* is a rear view of the bathtub, FIG. 1*b* a lateral view, FIGS. 2*a* and 2*b* shows a hatch whereas FIG. 3 illustrates the curvature of the hatch and FIG. 4 is a section showing a part of the bathtub.

Figure 1A:
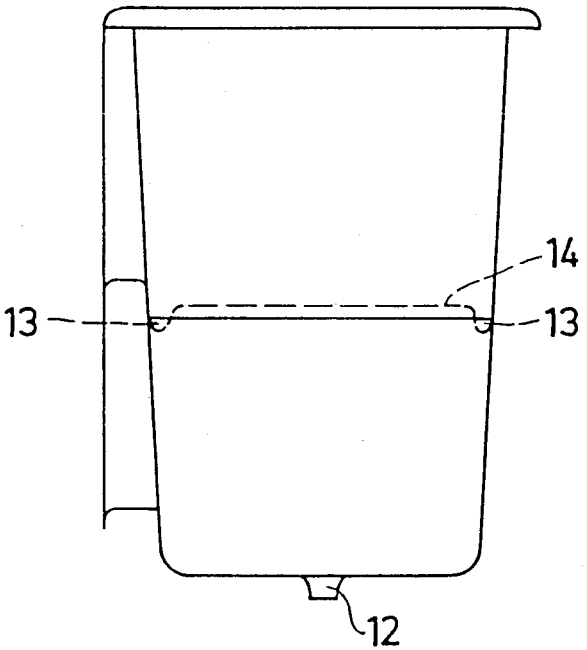

In FIG. 1*a* is shown a rear view of a bathtub 10 provided with an outlet 12, draining chutes 13 and a seat 14, seen in the direction of the arrow 0 in FIG. 1*b*. In FIG. 1*b* the bathtub 10 of FIG. 1 is shown in a lateral view with its opening 11, the outlet 12 the draining chutes 13 and the seat 14 and an outer handle 36, the use of which will be described in greater detail below.

In FIG. 2 a plane hatch 15 is shown with a sealing strip 16 and a lifting nob Hk fitted to the hatch 15.

Figure 2A:
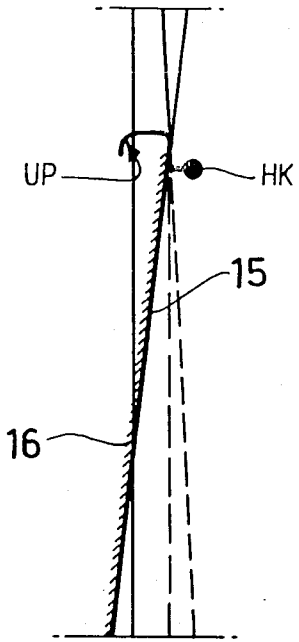

In FIG. 2*a* a rear view is shown of a freely suspended hatch 15 where UP is the point or line of suspension at the outer part of the rim. The upper edge of the hatch 15, in cross section, has the shape of an inverted U. When this edge is hooked over the rim of the bathtub 10 against an inclined or sloping wall the hatch 15 will assume a position that is shown dashed and will exert an outward pressure (a sealing pressure) on the lateral wall via the sealing strip 16. FIG. 2*b* shows the lateral view of the hatch 15 with its sealing strip 16. The area round the sealing strip is the sealing zone.

In FIG. 3 ABCDEFA is the other contour of the hatch $15^1$. The hatch is a part of the paralleltrapetsoid ABGF. Horizontal (x) and vertical (y) straight lines over the surface of the hatch represents a plane or flat hatch and the corresponding plane lateral wall. The bent or arched lines represent curvature inwards for a hatch. The curvature can be single-curved (corresponding to cutting points between the curved and straight lines) or double-curved corresponding to cutting points between vertical and horizontal lines. The arrows at D represent the curvature (free chamber) of the hatch according to the above away from the plane of the drawing.

From FIG. 3 it is apparent that with a doublecurved hatch 15[1] and a plane lateral wall and when the hatch is an initial moment is in contact at B a gap is established along BC, which continues towards D, E to F. The area at D is situated close to the straight line BF.

FIG. 4 is a partsection of the tub opening at the front edge of the seat 14 (see FIG. 1b). Furthermore FIG. 4 shows the hatch 15[1] with sealing strip 16. A draining chute 13 is partly visible The inner and outer handles 35 and 36 are fixed on a shaft that is inclined at an angle to the normal No of a sidewall of the bathtub. The axis of the shaft is illustrated at Ax. The passage of the shaft through the sidewall of the bathtub 10 is watertight, not shown. The handle 35, which is located near the seat 14 as shown in FIG. 1b, is shown dashed turned downwards corresponding to the position of the hatch 15[1] when the hatch is first located on its place. The handle 35 does in this position not prevent the location of the hatch 15[1] in its intended position. The handle 35 (and thus also the handle 36) is then turned, so that the handle 35 engages the inner surface of the hatch and presses the hatch outwardly so that the gap BCD, see FIG. 3, is closed. The outward pressure exerted on the hatch by the handle 35 is proportional to the angle through which the handle 35 is turned about the shaft axis Ax, due to the inclination of this shaft. The gap Sp (see FIG. 3) is then successively closed as the bathtub 10 is filled with water forcing the hatch 15[1] towards the inner sidewall of the bathtub 10.

I claim:

1. A sitting bathtub including a bottom, a generally horizontal seat having a front edge and a side wall surrounding said bottom and said seat and forming therewith an open-topped container having an upper edge, the side wall having a flat portion and said flat portion and the respective upper edge portion having an opening through which a person may enter and leave the bathtub, said opening having a lower portion which is disposed below and immediately in front of said seat and said opening also having an upper portion which is wider than said lower portion and which is disposed both in front of and immediately laterally of said seat, a separate, manually maneuverable hatch which is free of connection to the bathtub so as to be selectively placed inside and outside the bathtub by the user, said hatch having a front lower corner and also having a shape generally complementary to but larger than said opening so that when placed inside the bathtub the edge portion of said hatch overlies the edge portion of said opening whereby said hatch covers said opening and said hatch being arched inwardly so as to counteract a tendency to arch outwardly under the pressure of water when the bathtub is full of water; a sealing strip between the edge portion of said hatch the edge portion of said opening, said inwardly arched hatch and said side wall of the bathtub being so shaped that upon mounting said hatch inside said bathtub in overlying relationship to said opening contact between said edge portions is obtained initially at said front lower corner of said edge portions; an inner handle mounted inside said bathtub on said side wall adjacent said opening for movement between an unlatching position in which the handle is spaced from said hatch and latching positions in which the handle presses outwardly against the inner surface of said hatch at a location above said lower corner so that initially the lower parts of said hatch are in contact with said side wall, establishing an initial seal at the lower parts of said hatch and so that water when entering the bathtub exerts further pressure on said hatch, which pressure successively extends upwards as the water rises in the bathtub thereby completing sealing of the edge portion of said hatch to the edge portion of said opening.

2. A bathtub as in claim 1 wherein said inner handle extends generally radially from and is fixed to a rotatable shaft journaled in and extending through said side wall, said shaft having an outer handle fixed thereto outside said side wall for manual rotation of said shaft from outside said bathtub.

3. A bathtub as in claim 2 wherein said flat portion of said side wall is generally vertical and wherein said shaft is inclined relative to a line normal to said flat portion of said side wall such that the outward pressure extered by said inner handle on said hatch is proportional to the turning angle of said inner handle after contact has been established between said inner handle and said hatch.

4. A sitting bathtub having a bottom and a surrounding side wall which together form an open-topped container having an upper edge, the side wall and upper edge having an opening through which a person may enter and leave the bathtub, said bathtub including an internal seat and said opening being adjacent a side of said seat and being wider at and above the seat than below said seat, a separate, manually maneuverable hatch which is free of connection to the bathtub so as to be selectively placed inside and outside the bathtub by the user, said hatch having a front lower corner in front of said seat when said hatch is inside the bathtub and having an upper edge provided with an inverted U-shaped edge portion capable of hooking over and contacting the edge of the bathtub and allowing play toward and away from said wall; said hatch having a shape complementary to the shape of said opening and having dimensions greater than the dimensions of said opening so that when placed inside the bathtub the edge portion of said hatch overlies the edge portion of said opening whereby said hatch covers said opening, said hatch being inwardly arched so as to counteract a tendency to arch outwardly under the pressure of water when the bathtub is full of water; a seal between the edge portion of said hatch and the edge portion of said opening, said inwardly arched hatch and said side wall of the bathtub being so shaped that upon mounting said hatch inside said bathtub in overlying relationship to said opening contact between said edge portions is obtained generally at said front lower corner; an inner handle mounted inside said bathtub on said side wall adjacent said opening and near said seat for movement between an unlatching position in which the handle is spaced from said hatch and latching positions in which the handle presses outwardly against the inner surface of said hatch so that initially the lower parts of said hatch are in contact with said side wall, establishing an initial seal at the lower parts of said hatch and so that water when entering the bathtub exerts further pressure on said hatch, which pressure successively extends upwards as the water rises in the bathtub thereby completing sealing of the edge portion of said hatch to the edge portion of said opening.

5. A bathtub as in claim 4 wherein said inner handle extends generally radially from and is fixed to a rotatable shaft journaled in and extending through said side wall, said shaft having an outer handle fixed thereto outside said side wall for manual rotation of said shaft from outside said bathtub.

6. A bathtub as in claim 5 wherein said flat portion of said side wall is generally vertical and wherein said shaft is inclined relative to a line normal to said flat portion of said side wall such that the outward pressure exerted by said inner handle on said hatch is proportional to the turning angle of said inner handle after contact has been established between said inner handle and said hatch.

* * * * *